US005738136A

United States Patent [19]

Rosenberg

[11] Patent Number: 5,738,136

[45] Date of Patent: Apr. 14, 1998

[54] PULSATOR DEVICE AND METHOD

[75] Inventor: Peretz Rosenberg, Moshav Beit Shearim, Israel

[73] Assignee: Super Disc Filters Ltd., Natania, Israel

[21] Appl. No.: 655,370

[22] Filed: May 3, 1996

[30] Foreign Application Priority Data

Jun. 2, 1995 [IL] Israel ..... 114001

[51] Int. Cl.[6] ..... F17D 3/00

[52] U.S. Cl. ..... 137/12; 137/624.14; 137/505.13; 222/518; 222/510

[58] Field of Search ..... 137/624.14, 624.18, 137/504, 396, 512.5, 513, 505.13, 469, 471, 470, 516.27, 516.25; 222/518, 56, 510

[56] References Cited

U.S. PATENT DOCUMENTS

| | | | |
|---|---|---|---|
| 2,702,044 | 2/1955 | Johnston | 137/512.5 |
| 2,781,775 | 2/1957 | Merrill | 137/512.5 |
| 4,949,747 | 8/1990 | Rosenberg | 137/624.14 |
| 5,144,980 | 9/1992 | Rosenberg | 137/624.14 |
| 5,375,739 | 12/1994 | Granfelt | 137/396 |
| 5,474,105 | 12/1995 | Able | 137/504 |

*Primary Examiner*—Denise L. Ferensic
*Assistant Examiner*—Ramyar Farid
*Attorney, Agent, or Firm*—Benjamin J. Barish

[57] ABSTRACT

A fluid pulsator includes a housing containing a fluid reservoir, an inlet port, an outlet port, and a valve assembly biassed to an open position by a predetermined biassing force, the valve assembly includes a surface exposed to the inlet pressure to close the valve assembly when subjected to an inlet pressure greater than the biassing force. An inlet control passageway into the reservoir is dimensioned to produce a flow rate smaller than that in an outlet control passageway from the reservoir. The arrangement is such that upon the application of pressurized fluid to the inlet port larger than the biassing force, the valve assembly is actuated to close the outlet control passageway while the fluid is inletted into the fluid reservoir via said inlet control passageway at a relatively low rate until the pressure in the fluid reservoir builds up to that of the inlet pressure less than that of the biassing force, whereupon the valve assembly is automatically moved to open and to discharge a pulse of the fluid from the fluid reservoir.

13 Claims, 4 Drawing Sheets

FIG. 4
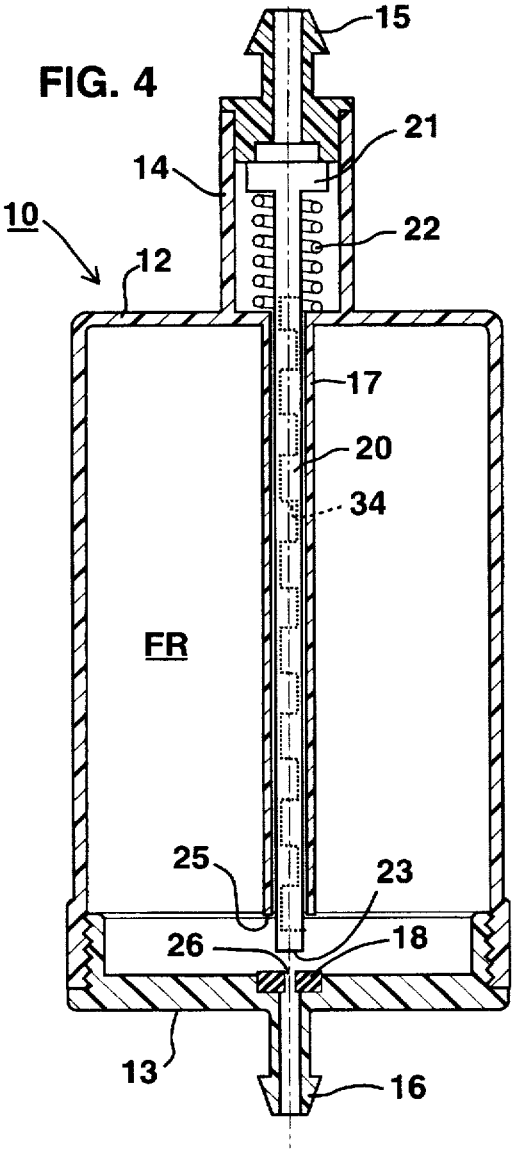
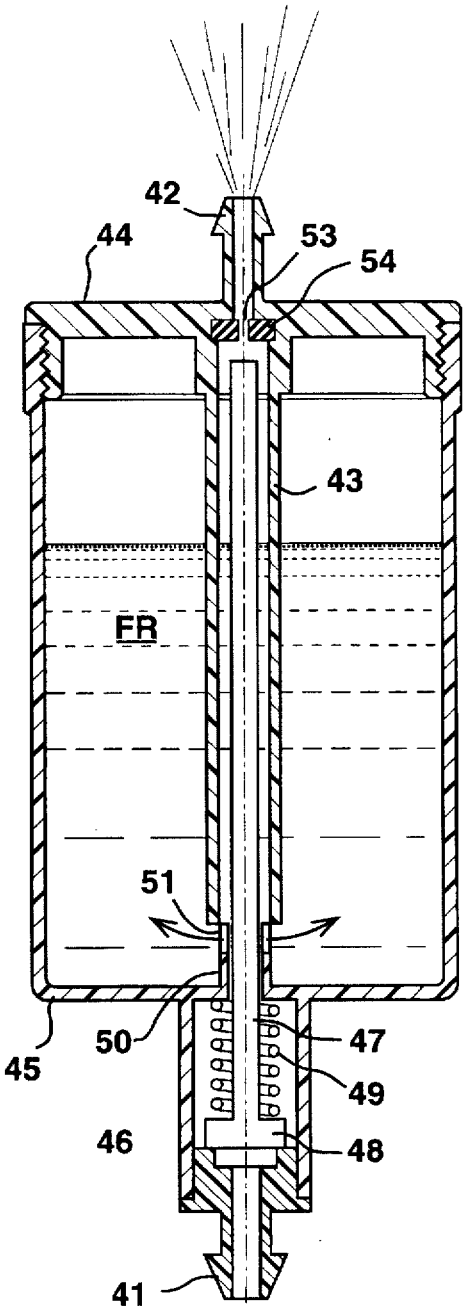
FIG. 5

PULSATOR DEVICE AND METHOD

FIELD AND BACKGROUND OF THE INVENTION

The present invention relates to a pulsator device and method, for producing pulses in a fluid. The invention is particularly useful for pulsating a liquid and is therefore described below with respect to this application, but if will be appreciated that the invention could also be used for pulsating a gas.

There are many applications for liquid pulsators, for example, water irrigation systems for supplying water sprinklers or drippers with pulses of water, water cooling systems for cooling crops or animals by pulsated sprays during exceptional hot conditions, and the like. Examples of various pulsator devices that have been developed are described in my prior Patents 74332 (U.S. Pat. No. 4,781,217), 88014 (U.S. Pat. No. 4,949,747), and 92886 (U.S. Pat. No. 5,201,342). As a rule, such known pulsators are constructed for predetermined inlet pressure ranges, and/or for outputting predetermined outlet pressures despite variations in the inlet pressure.

However, there are many applications where it is desirable to use a pulsator at substantially different inlet pressures, and/or to discharge pulses at substantially different outlet pressures. For example, it may be desirable to use the pulsators in irrigation systems wherein the water pressure is in the order of two or three atmospheres, or at other locations wherein it may be in the order of ten or more atmospheres. Similarly, it may be desirable to use pulsators with sprinklers requiring a relatively high discharge pressure, or with drippers requiring a relatively low discharge pressure. When pulsators are used for cooling purposes, it may be desirable to be able to vary the discharge pulse pressure and rate according to the ambient temperature conditions. In such cases, it is generally necessary either to replace the pulsator by one designed for the particular application, or to modify the pulsator construction in order to adapt it for a different inlet pressures and/or for different outlet pressures.

BRIEF SUMMARY OF THE INVENTION

An object of the present invention is to provide a pulsator, and also to a method of pulsating a fluid, having advantages in the above respects.

According to one aspect of the present invention, there is provided a fluid pulsator, comprising: a housing defining a fluid reservoir; an inlet port connectible to a source of pressurized fluid and communicating with the fluid reservoir via an inlet control passageway; an outlet port communicating with the fluid reservoir via an outlet control passageway; a valve assembly movable to an open position or to a closed position with respect to the outlet control passageway and including biassing means for urging the valve assembly to its open position by a predetermined biassing force, and surface exposed to the inlet pressure to move the valve assembly to its closed position when subjected to an inlet pressure greater than the biassing force; the inlet control passageway being dimensioned to produce a flow rate smaller than that of the outlet control passageway such that upon the application of pressurized fluid to the inlet port larger than the biassing force, the valve assembly is actuated to move to its closed position with respect to the outlet control passageway while the pressurized fluid is inletted into the fluid reservoir via the inlet control passageway at a relatively low rate until the pressure in the fluid reservoir builds up to that of the inlet pressure less than that of the biassing force, whereupon the valve assembly is automatically moved to its open position to discharge a pulse of the fluid from the fluid reservoir at a high rate via the outlet control passageway and outlet port.

In the described preferred embodiments, the biassing means comprises a spring urging the valve assembly to the open position. In addition, the inlet port is at one of the housing, the outlet port and outlet control passageway are at the opposite end of the housing, and the valve assembly includes a valve rod extending through the housing from the inlet port to the outlet control passageway at the opposite end of the housing. One end of the valve rod, adjacent the inlet port, is formed with the inlet-pressure exposed surface of the valve assembly; and the opposite end of the valve rod, adjacent the outlet port, is effective to open and close the outlet control passageway.

According to another aspect of the present invention, there is provided a method of producing fluid pulses, comprising: continuously introducing fluid via an inlet control passageway into a fluid reservoir at a slow rate while an outlet control passageway is closed, to gradually build up the pressure within the fluid reservoir; when the pressure in the fluid reservoir has built up to a predetermined value, equal to the inlet pressure less a predetermined bias, automatically opening the outlet control passageway to discharge a fluid pulse therefrom at a high rate; and when the pressure within the fluid reservoir has dropped below the predetermined value, automatically closing the outlet control passageway to terminate the discharge of the fluid pulse, and to start another build-up of the pressure within the fluid reservoir for the generation of the next pulse to be discharged therefrom.

It will thus be seen that such a pulsator device and method can be applied to a wide variety of applications, in which the inlet pressure varies widely over a very substantial range, and/or the pressure of the outlet pulse is to vary over a substantial range. Thus, the pressure of the outlet pulse will always be that of the inlet pressure less the biassing force produced by the biassing spring. The same pulsator may therefore be used in irrigation systems, cooling systems, or in other applications where the inlet pressure may vary widely or where the outlet pressure to be produced may vary widely.

Further features and advantages of the invention will be apparent from the description below.

BRIEF DESCRIPTION OF THE DRAWINGS

The invention is herein described, by way of example only, with reference to the accompanying drawings, wherein:

and FIGS. 2, 3, 4 and 5 are views similar to that of FIG. 1 illustrating four additional constructions of a pulsator device in accordance with the present invention.

DESCRIPTION OF A PREFERRED EMBODIMENT

Figure 1:
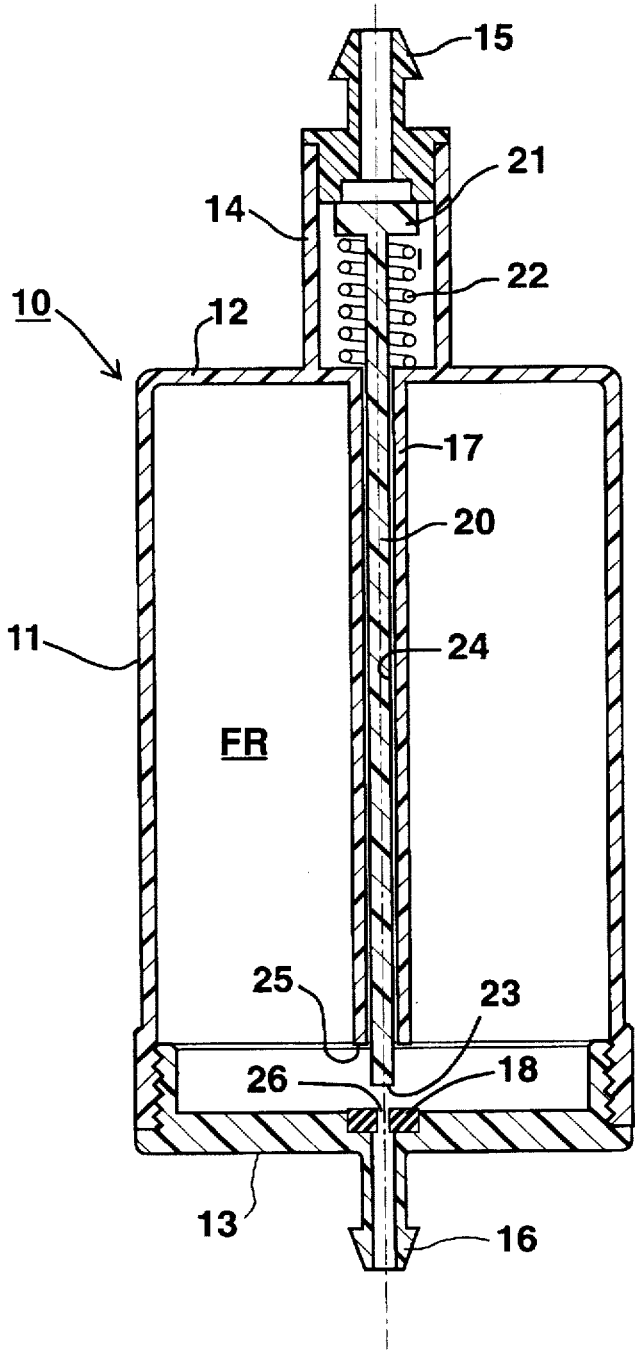
FIG. 1 illustrates one form of pulsator device constructed in accordance with the present invention.

The pulsator device illustrated in FIG. 1 includes a housing, generally designated 10, constituted of a main cylindrical section 11, defining a fluid reservoir FR, closed at one end by an integrally formed end wall 12, and at the opposite end by a removable end wall 13. End wall 12 is integrally formed with a sleeve 14 constituting the inlet port into housing 10 and connectible to a source of pressurized fluid by a connector 15. End wall 13 at the opposite end of the housing is integrally formed with a connector 16 constituting the outlet port, coaxial with the inlet port 15, from which the pulses are discharged.

End wall 12 of housing 10 is further formed with an inner tubular section 17 aligned with, but of smaller diameter than, the external sleeve 14. Tubular section 17 extends from end wall 12 coaxially with respect to the inlet and outlet ports 14, 16, but terminates short of end wall 13.

End wall 13 includes a valve seat 18 coaxial with both the housing tubular section 17, and the outlet port 16. Valve seat 18 is openable and closable by a valve rod 20 of a valve assembly which includes an enlarged head 21 within the external sleeve 14. Valve rod 20 extends through the inlet port 14 coaxial with it and the outlet port 16, and is movable towards and away form the outlet port 16 to close and open the outlet port. The valve rod is urged by spring 22 to the position of the rod illustrated in FIG. 1, wherein its end 23 is spaced from valve seat 18. Its enlarged head 21 is exposed to the inlet pressure applied via inlet port 15 and is effective to move rod 20 to bring its end 23 into engagement with valve seat 18, to thereby close the outlet port 16.

Valve rod 20 is of slightly smaller outer diameter than the inner diameter of the housing tubular section 17, so as to provide a clearance 24 between the two. This clearance 24 constitutes an inlet control passageway for the fluid leading from the inlet port 14, via the open end 25 of tubular section 17, into the interior of housing 10. Valve seat 18 is formed with an opening 26 which defines an outlet control passageway leading from the interior of housing 10 to the outlet port 16. The inlet control passageway defined by clearance 24 is dimensioned to produce a fluid flow rate smaller than the outlet control passageway defined by opening 26 in valve seat 18.

Figure 1A:
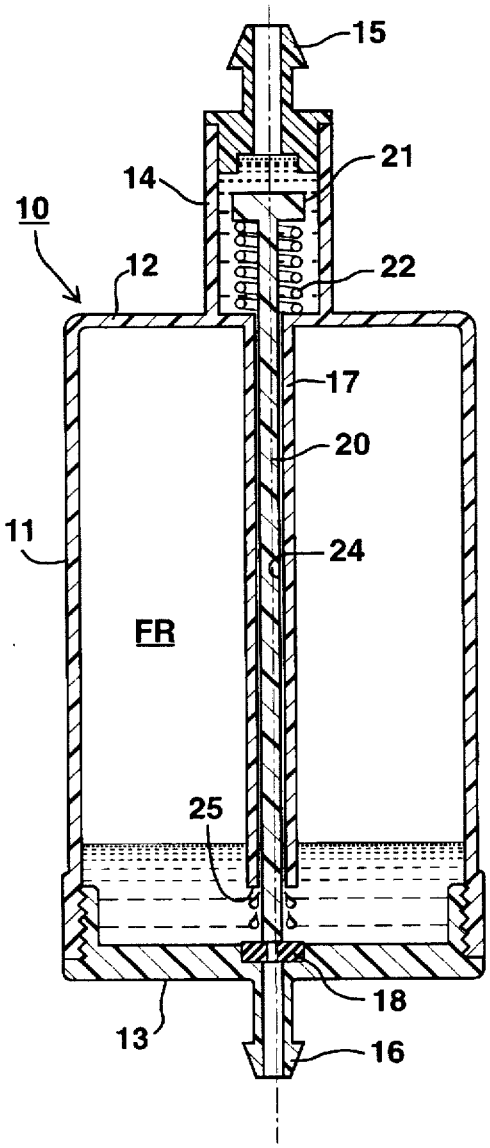
FIGS. 1*a* and 1*b* illustrate two stages in the operation of the device of FIG. 1.

The pulsator illustrated in FIG. 1 may be used for producing pulses of a liquid, such as irrigation water, a cooling spray or the like, in the following manner:

With the device oriented such that housing 10 assumes the vertical position illustrated in FIG. 1, the inlet port 14 is connectible to a source of pressurized fluid, e.g., the water supply line, and the outlet port 16 is connected to an irrigating device, a cooling sprayer, or the like. In this normal condition of the device, spring 22 urges valve rod 20 to its raised condition, with its lower end 23 spaced above valve seat 18. However, as soon as the inlet pressure is applied, it produces a force against head 21 moving valve rod 20 against spring 22 to the lower position of the valve rod wherein its end 23 closes opening 26 in valve seat 18 (FIG. 1*a*).

Figure 1B:
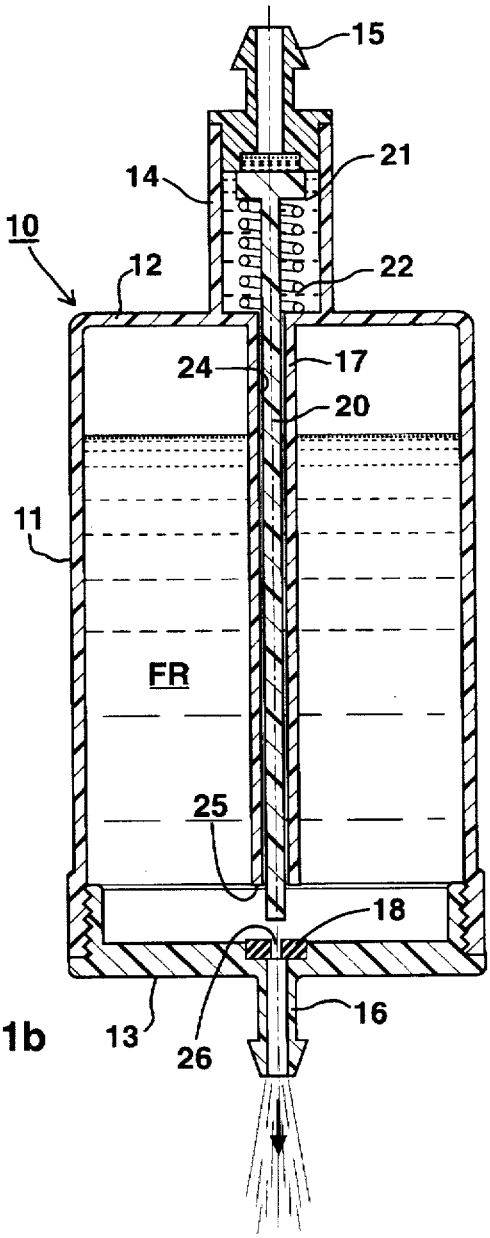

The water thus inletted into the interior of housing 10 via clearance 24 and the open end 25 of the housing tubular section 17, gradually fills the fluid reservoir FR within the housing and thereby also gradually increasing the pressure within the housing. When the pressure within the housing exceeds that of the inlet pressure less the force exerted by biassing spring 22, the latter spring moves valve rod 20 to its open condition (FIG. 1*b*), thereby producing a discharge via opening 26 and outlet port 16. This discharge is at the pressure of the liquid within the housing, and lowers the pressure within the housing, sufficient to cause the inlet pressure to move valve rod 20 back to its closed position with respect to opening 26, whereupon the pressure within the housing again gradually increases until the next pulse is produced.

It will thus be seen that the rate of build-up of pressure within housing 10 depends on the flow rate produced by the inlet control passageway defined by clearance 24 which, as indicated above, must be smaller than the flow rate permitted by the outlet control passageway defined by outlet aperture 26 of valve seat 18. As one example, valve rod 20 may have an outer diameter of 4 mm, a length of 100 mm, and a clearance 24 of 0.2 mm, in which case an inlet pressure of about 4 atmospheres would produce a discharge rate of about 8 liters/hour.

Figure 2:
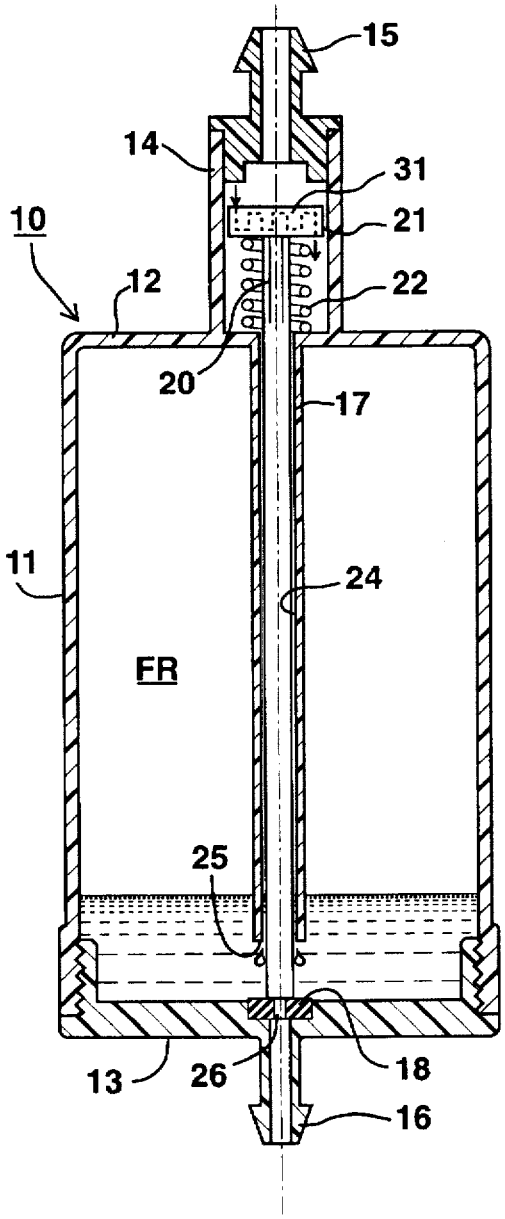
Figure 3:
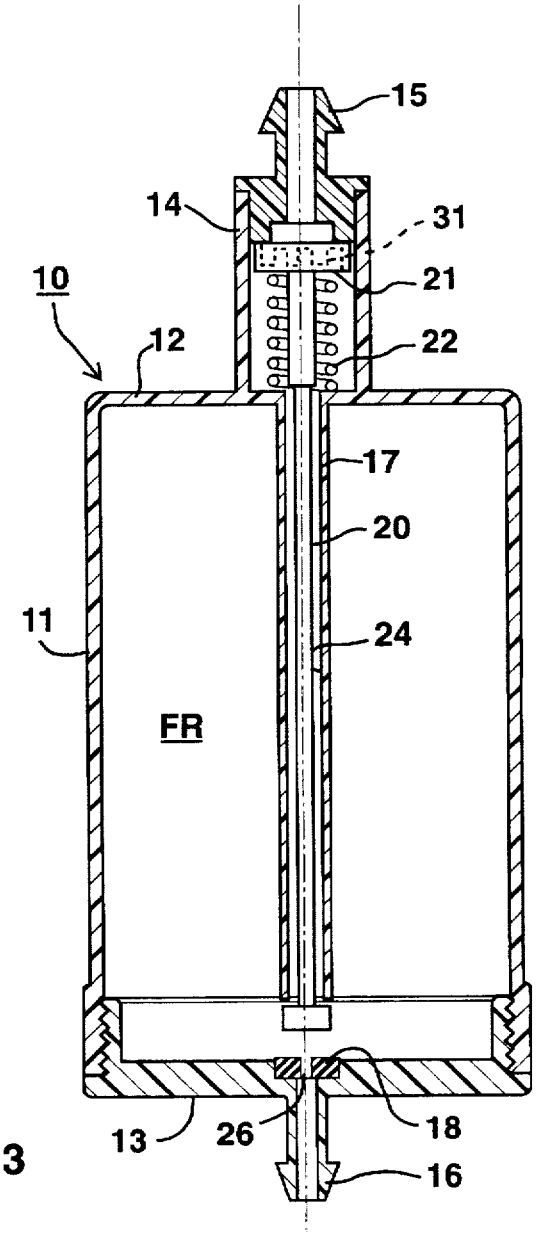

FIGS. 2, 3 and 4 illustrate variations in the structure for providing the inlet control passageway corresponding to clearance 24 in FIG. 1.

In FIG. 2, the inlet control passageway is provided in head 21 of the valve rod 20, e.g., in the form of a labyrinth as used in irrigation emitters. In such a case, the clearance 24 would be larger than in FIG. 1, so that the controlled rate of inflow of the liquid into the fluid reservoir FR would be determined primarily or solely by passageway 31 in the rod head 21. In all other respects, the pulsator illustrated in FIG. 2 is constructed and operates in the same manner as described above with respect to FIG. 1, and therefore the same reference numerals have been used to identify the corresponding parts.

FIG. 3 illustrates a pulsator similar to the construction of FIG. 2, except in this case the valve rod 32 is of substantially smaller diameter than the housing tubular section 17, but terminates in an enlarged head 33 at the opposite end which opens and closes opening 26 in valve seat 18. FIG. 4 illustrates a similar construction except that the inlet control passageway is through the valve rod 17 itself, as schematically shown at 34, rather than through the clearance 24 in FIG. 1 or through the head 21 in FIG. 2. In all other respects, however, the pulsators illustrated in FIGS. 3 and 4 are constructed and operate in the same manner as described above with respect to FIG. 1.

FIG. 5 illustrates a further construction wherein the housing, therein designated 40, is oriented in a vertical position but with the inlet port 41 at the lower end of the housing, and the outlet port 42 at the upper end of the housing. In this case, an internal tubular housing section 43 extends from the housing end wall 44 containing the outlet port 42 and terminates short of the housing end wall 45 containing the inlet port 41. Housing end wall 45 includes the external sleeve 46 for the end of valve rod 47 carrying the inlet-pressure exposed surface defined by head 48, and the spring bias 49 urging the valve rod to an open position. Housing end wall 45 is also formed with an internal tubular section 50 spaced from tubular section 43 to define an inlet 51 into the lower end of the fluid reservoir FR within housing 40. Spring 49 biasses valve rod 47 so that the opposite end 52 of the valve rod is normally spaced from opening 53 in valve seat 54 aligned with the outlet port 42.

The pulsator illustrated in FIG. 5 operates in a similar manner as the others. Thus, before the inlet pressure is applied to inlet port 41, spring 49 biasses valve rod 47 to the open position illustrated in FIG. 5. However, as soon as inlet pressure is applied, valve rod 47 moves to its closed position against valve seat 54, whereupon the fluid is inletted at the relatively slow rate determined by the inlet flow control passageway (e.g., the clearance 55 between the valve rod and tubular section 50 of the housing) thereby also gradually building up the pressure within the housing. As soon as the fluid pressure within the housing exceeds the inlet pressure, less the force of spring 49, valve rod 47 is moved to its open position, thereby producing a discharge of the liquid via opening 51, the clearance 56 between valve rod 47 and tubular section 43 of the housing, outlet aperture 53, and the outlet port 42, until the pressure within the housing drops to again move end 52 of valve rod 47 against valve seat 54.

While the invention has been described with respect to several preferred embodiments, it will be appreciated that these are set forth merely for purposes of example, and that many other variations, modifications and applications of the invention may be made.

I claim:

1. A fluid pulsator, comprising:

a housing defining a fluid reservoir;

an inlet port at one end of said housing connectible to a source of pressurized fluid and communicating with said fluid reservoir via an inlet control passageway;

an outlet port at the opposite end of said housing coaxial with said inlet port and communicating with said fluid reservoir via an outlet control passageway;

a valve assembly including a valve rod extending through said inlet port, coaxial with said inlet and outlet ports, and movable axially towards and away from said outlet port to close and open same;

said valve assembly including a biassing spring for urging the valve rod to open the outlet port;

said valve rod including a control surface on the inlet side of said inlet port exposed to the inlet pressure for moving the valve assembly to its closed position when subjected to an inlet pressure greater than said biassing force;

said inlet control passageway being dimensioned to produce a flow rate smaller than that of said outlet control passageway such that upon the application of pressurized fluid to said inlet port larger than said biassing force, the valve assembly is actuated to move to its closed position with respect to the outlet control passageway while the pressurized fluid is inletted into the fluid reservoir via said inlet control passageway at a relatively low rate until the pressure in the fluid reservoir builds up to that of the inlet pressure less than that of said biassing force, whereupon the valve assembly is automatically moved to its open position to discharge a pulse of the fluid from the fluid reservoir at a high rate via said outlet control passageway and outlet port.

2. The pulsator according to claim 1, wherein said housing includes an outer section defining said fluid reservoir, and a tubular section coaxial with said inlet and outlet ports for enclosing said valve rod; said outlet control passageway including a valve seat in alignment with said housing tubular section; said valve rod of the valve assembly extending through said housing tubular section with the end of the rod adjacent to said outlet control passageway being movable to open or close said valve seat.

3. The pulsator according to claim 2, wherein said housing is oriented in a vertical position, with said inlet port at its upper end and said outlet port at its lower end; said housing tubular section extending from said inlet port towards said outlet port but terminating short of said outlet port.

4. The pulsator according to claim 2, wherein said housing is oriented in a vertical position, with said outlet port at its upper end and said inlet port at its lower end; said housing tubular section extending from said outlet port towards said inlet port but terminating short of said inlet port.

5. The pulsator according to claim 1, wherein the end of the valve rod adjacent to said inlet port includes a large head constituting said inlet-pressure exposed surface of the valve assembly.

6. The pulsator according to claim 5, wherein said spring is interposed between said enlarged head of the valve rod and the housing.

7. The pulsator according to claim 5, wherein said inlet control passageway includes a clearance between the valve rod and said tubular section of the housing.

8. The pulsator according to claim 5, wherein said inlet control passageway is in said head of the valve rod.

9. The-pulsator according to claim 5, wherein said inlet control passageway is in said valve rod.

10. A method of producing fluid pulses, comprising:

providing a housing defining a fluid reservoir, an inlet at one end of said fluid reservoir, an outlet at the opposite end of said fluid reservoir coaxial with said inlet, and a valve rod extending through said inlet, coaxial with said inlet and outlet, and movable towards and away from said outlet to close and open said outlet;

said valve rod including a biassing spring which urges said valve rod to its open position by a predetermined biassing force, and a surface exposed to the inlet pressure to move the valve rod to its closed position when subject to an inlet pressure greater than said biassing force;

continuously introducing fluid via said inlet into said fluid reservoir at a slow rate while said outlet is closed by said valve rod, to gradually build up the pressure within said fluid reservoir; when the pressure in the fluid reservoir has built up to a predetermined value, equal to the inlet pressure less the predetermined biassing force, automatically opening said outlet to discharge a fluid pulse therefrom at a high rate; and when the pressure within the fluid reservoir has dropped below said predetermined value, automatically closing said outlet to terminate the discharge of said fluid pulse, and to start another build-up of the pressure within the fluid reservoir for the generation of the next pulse to be discharged therefrom.

11. The method according to claim 10, wherein said housing includes an outer section defining said fluid reservoir, and a tubular section coaxial with said inlet and outlet for enclosing said valve rod; said outlet including a valve seat in alignment with said housing tubular section; said valve rod extending through said housing tubular section with the end of the rod adjacent to said outlet being movable to open or close said valve seat.

12. The method according to claim 11, wherein said housing is oriented in a vertical position, with said inlet at its upper end and said outlet at its lower end; said housing tubular section extending from said inlet towards said outlet but terminating short of said outlet.

13. The method according to claim 11, wherein said housing is oriented in a vertical position, with said outlet at its upper end and said inlet at its lower end; said housing tubular section extending from said outlet towards said inlet but terminating short of said inlet.

* * * * *